United States Patent [19]

Steinmann et al.

[11] Patent Number: 4,894,584

[45] Date of Patent: Jan. 16, 1990

[54] ELECTRIC LAMP PROVIDED WITH A GETTER INCLUDING PALLADIUM

[75] Inventors: Maarten W. Steinmann, Eersel; Wilhelmus A. A. A. Martens; Johannes J. G. S. A. Willems, both of Eindhoven, all of Netherlands

[73] Assignee: U.S. Philips Corporation, New York, N.Y.

[21] Appl. No.: 192,430

[22] Filed: May 10, 1988

[30] Foreign Application Priority Data

May 13, 1987 [NL] Netherlands ..... 8701136

[51] Int. Cl.[4] ..... H01J 61/26

[52] U.S. Cl. ..... 313/557

[58] Field of Search ..... 313/557, 553

[56] References Cited

U.S. PATENT DOCUMENTS 3,644,773 2/1972 Coaton et al. ..... 313/557 X 4,305,017 12/1981 Kuus et al. ..... 313/557

FOREIGN PATENT DOCUMENTS 0131947 10/1980 Japan ..... 313/553

*Primary Examiner*—Palmer C. DeMeo

*Attorney, Agent, or Firm*—Norman N. Spain

[57] ABSTRACT

The electric lamp has a getter capable of binding hydrogen, oxygen and stoichiometrically water at a comparatively low temperature. The getter comprises Pd as a first metal, chemically bound to a second metal from the group Zr and Y, the mol. % of the first metal in the getter lying between 0.4 and 15. The getter further comprises chemically bound oxygen, mole 0/mole second metal being 0.02–1.0. The particle size is ≦40 μm.

5 Claims, 5 Drawing Sheets

ELECTRIC LAMP PROVIDED WITH A GETTER INCLUDING PALLADIUM

BACKGROUND OF THE INVENTION

The invention relates to an electric lamp provided with a translucent lamp vessel sealed in a vacuum-tight manner;

a light source arranged inside the lamp vessel;

current supply conductors extending from the light source through the wall of the lamp vessel to the exterior;

a getter inside the lamp vessel, which comprises an intermediate compound of a first metal with a second metal.

Such a lamp is known from German Offenlegungsschrift 1,905,646.

In the known lamp, the getter is an alloy of at least 5% by weight of at least one metal selected from the group III, IV, V of the periodic table and tungsten with at least one metal selected from the group VIII of the periodic table, and copper, which alloy has a melting point of at most 1250° C. This getter may be inter alia an zirconium/nickel alloy containing 5% by weight of Zr or $Zr_2Ni$, which latter alloy contains 75.7% by weight of Zr. The getter serves to bind oxygen in the lamp.

In various types of lamps, however, water is a very harmful impurity. This substance may be present in a large quantity in lamps having a lamp vessel which is coated electrostatically with a powder. In order for a lamp vessel to be coated electrostatically, the resistivity of the powder this resistivity to be applied is of importance and the value is strongly influenced by the moisture content of the powder. Thus, by coating a lamp vessel electrostatically moisture is introduced into the lamp vessel.

In a lamp having incandescent tungsten parts, for example a filament, water can produce tungsten oxide and hydrogen. The oxide can evaporate and be deposited on the wall of the lamp vessel. Tungsten oxide may also react with the hydrogen to form tungsten, which is deposited at colder areas, and water. Consequently, water is the carrier of a cycle process, in which tungsten is transported from the filament to colder areas. This leads to a reduced transmission of light and to an accelerated disintegration of said filament and a short life of the lamp.

Hydrogen, for example hydrogen obtained by decomposition of water, may lead to reduction of glass metal connections, as a result of which a lamp vessel becomes leaky along current supply conductors and the lamp fails prematurely. Hydrogen may further cause flashover, for example in evacuated lamp vessels, or may penetrate through a quartz glass wall into a discharge vessel and lead to an increase of the ignition voltage of the discharge arc.

Oxygen in a lamp may lead to an undesired oxidation.

Water on a harmful substance in lamps because its harmful effect is stronger than that of oxygen and hydrogen together. It is therefore of great importance that means are available by which water can be bound. Furthermore, it is of importance that, when binding water, no hydrogen or oxygen is formed which is not also bound. It is also of importance that means are avaiable which are capable of binding molecular oxygen and hydrogen.

SUMMARY OF THE INVENTION

The invention has for its object to provide a lamp of the kind described in the opening paragraph having a getter which is capable of binding not only hydrogen and oxygen, but also practically stoichiometrically water, especially at comparatively low temperatures.

According to the invention, this object is achieved by getter which comprises Pd as a first metal, which metal is chemically bound to at least one second metal from the group consisting of Zr and Y, the ratio "mole first metal$\times$100%/(mole first metal plus mole second metal)" lying in the range of 0.4–15%, and additionally chemically bound oxygen, the ratio "mole 0/mole second metal" lying in the range of 0.02–1.0 and the getter having a particle size of mainly $\leqq 40$ $\mu$m.

The getter according to the invention is capable of binding water substantially stoichiometrically even at comparatively low temperatures, for example temperatures in the range of 150°–300° C. and of further binding oxygen and hydrogen. The working rate of the getter and further its capacity are considerably higher than those of the related getters known from the said Offenlengungsschrift.

BRIEF DESCRIPTION OF THE INVENTION

Figure 1:
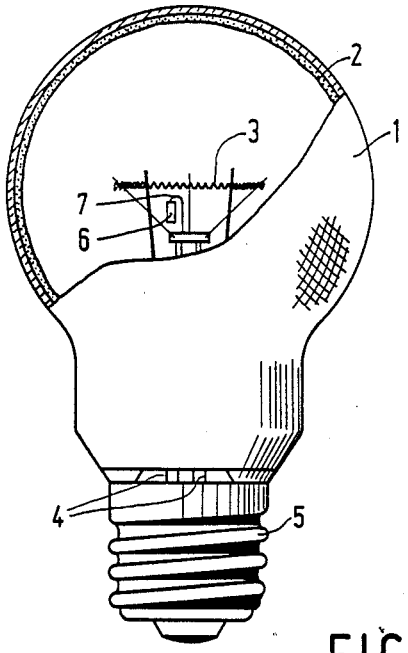
FIG. 1 is a side elevation, in part, of an incandescent lamp provided with a getter of the invention.

A more complete understanding of the invention will now be described in greater detail.

It is easy to provide an electric lamp with the getter. The getter can be provided as a powder layer on a part of the lamp, for example on a current supply conductor or on a support wire or a mount. For the purpose, a dispersion of the getter in a solvent with or without a binder, may be used, for example as a dispersion in a solution of nitrocellulose in butyl acetate. The getter may alternatively be present as powder in an envelope open to gas or may be present in molded form, for example a pressed or sintered pill.

The getter can be readily manipulated and stored at room temperature. It is also possible to subject the lamp to manufacturing steps in which lamp components are exposed to air at elevated temperature. In this case, if desired, to obtain the getter, material of the said composition of metals may be used which has an insufficient oxygen content. The initial oxygen content a material must have to have reached already immediately after the manufacture of the lamp the said ratio "mole 0/mole second metal" depends upon the conditions to which the material is subjected during the manufacture of the lamp. In a small series of experiments this initial oxygen content can be readily determined for a given lamp and a given manufacturing process.

With ratios of the getter metals lying considerably above 15% not only is the capacity for gas absorption comparatively low, but also the hydrogen pressure at which hydrogen abosorption takes place is comparatively high. With ratios lying considerably below 0.4%, the speed of gas absorption is low.

In a favourable embodiment, the mole ratio of the first metal to the first plus second metal×100% in the getter lies in the range of 2–10% (mol/mol). The getter then not only has a high capacity and a low hydrogen residual pressure, but also a high gas absorption rate. A favourable result is that the content of the comparatively expensive metal Pd, is the low.

It is favourable for the capacity of the getter for its oxygen content at the beginning of the life of the lamp to be considerably below 1.0 in the range of 0.02–1.0 (mol 0/mol second metal), for example between 0.05 and 0.2. Hydrogen is absorbed only very slowly in getters employing these ratios in the range of 0.05 to 0.2.

If the particle size of the getter is considerably larger than 40 μm, the specific surface area of the getter is small and hence its absorption rate is low. If the particle size of the getter lies far below 0.1 μm, the getter has a very high rate of absorption, it is true, but the getter is then only slightly capable of withstanding the conditions of manufacturing of the lamp. An optimum getter effect is obtained with a particle size in the range of 0.1–40 μm.

The lamp according to the invention may be an incandescent lamp, the light source is then a filament, or it may be a gas discharge lamp, for example a high-pressure discharge lamp. The light source may then be a pair of electrodes in an ionizable medium surrounded by an inner envelope. Alternatively, the lamp may be, for example, a low-pressure mercury discharge lamp. The light source may then be a pair of electrodes in a mercury-containing gas.

An embodiment of the lamp according to the invention is shown in the drawings. The drawings also show results of experiments with the getter of the invention and with a prior art getter.

Figure 8:
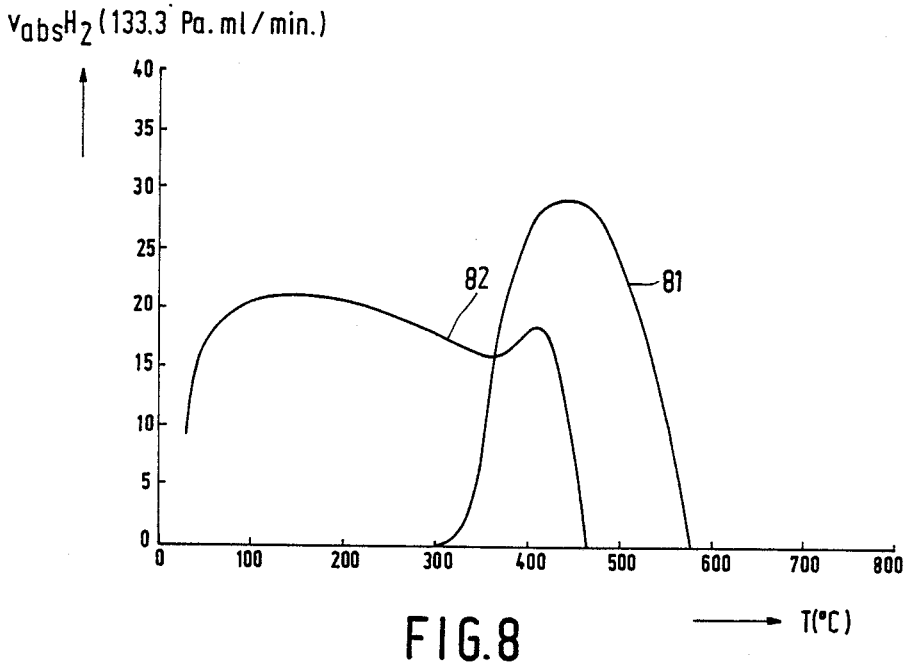
FIG. 8 is a graph comparing the rates of reaction of two getters with hydrogen.

FIG. 8 reaetion speed of two materials with hydrogen.

In FIG. 1, the incandescent lamp has a translucent glass lamp vessel 1, which is sealed in a vacuum-tight manner and in which a light source 3, a filament, is arranged. Current supply conductors 4 extend from the light source 3 through the wall of the lamp vessel 1 to the exterior and are connected there to a lamp cap 5. The lamp vessel 1 is coated at its inner surface with an electrostatically applied powder layer 2. A getter 6 comprising particles of an intermetallic compound of a first metal with a second metal is arranged within the lamp vessel 1.

The getter 6 comprises Pd as a first metal, chemically bound to at least a second metal selected from the group consisting of Zr and Y, the ratio "mole first metal×100% /(mole first metal plus mole second metal)" lying in the range of 0.4–15%; and chemically bound oxygen, the ratio "mole 0/mole second metal" lying in the range of 0.02–1.0 and the particle size of the getter being mainly ≦40 μm. In the Figure, the getter particles are pressed around a wire 7 to form a pill.

225 V 60 W lamps were manufactured on a normal production machine. The lamps had an uncoated transparent lamp vessel having a diameter of 60 mm or had such a lamp vessel provided with a white electrostatically applied coating of about 57 mg of $SiO_2$ and about 6 mg of $TiO_2$. The filament was provided with 170 μg of red phosphorus. All lamps were evacuated because the failure of the getter to absorb harmful gases, such as oxygen, hydrogen and especially water becomes manifest therein most strongly. The lamps were operated till the end of their lives, as the case may be in a "hot pot" (H.P), i.e. a substantially closed luminaire in which the temperature increases to a comparatively high value during operation. Lamps were manufactured with and without a getter according to the invention. The getter consisted of 8 mg of powder having a particle size of 0.1–40 μm of Pd chemically bound to Zr, in which mole Pd×100%/(mole Pd plus mole ZR)"=8.7%, and chemically bound oxygen, where "mole 0/mole Zr"=0.1. This powder was mixed with 16 mg of nickel powder and was pressed to a pill of 24 mg. As will be illustrated hereinafter, the nickel powder itself does not exhibit absorbing properties. The nickel powder serves to prevent the pill after absorption of gases from cracking and disintegrating thus not retaining its position in the lamp. The temperature of the getter during operation of the lamp amounted to about 300° C.

The results of the experiment are shown in Table 1:

TABLE 1

| Lamp | Coating | H.P. | Getter | Life (hr) | Deviation (%) |
|---|---|---|---|---|---|
| I | + | − | + | 1783 | 22.4 |
| II | + | + | + | 1326 | 18.9 |
| III | + | − | − | 344 | 18.2 |
| IV | + | + | − | 63 | 27.2 |
| V | − | − | − | 1644 | 24.2 |

+ = yes
− = no

The lamps I and II are in accordance with the invention. The lamps III and IV are identical thereto, but no getter is present therein. The lamps V are reference lamps, which, just like the remaining lamps, are manufactured on a production machine, but in which the water-containing powder layer is not present. There were fifteen lamps per group I to V.

A comparison of lamps I and V shows that in lamps I according to the invention the unfavourable effect of water from the powder layer is completely eliminated (see lamps III), while the getter further has neutralized the harmful effect of residual gases, which were present in the reference lamps V. The deviation of the life of the lamps I is of the same order as that of lamps V, but smaller.

The getter has a very strong effect on lamps operated in a hot environment, which appears from comparison of the lamps II with the lamps IV. The deviation of the life is moreover considerably smaller.

The getter is consequently very active in suppressing the harmful effect of residual gases, such as water, hydrogen and oxygen.

The getter was mnaufactured as follows. Pd and Zr were mixed in a molar ratio of 8.7/91.3 in powder form and melted under argon in a discharge arc. After cooling, the melt was crumbled and hydrogenated. The reaction product was pulverized and sieved to obtain particles having a size of 0.1–40 μm. This powder was dehydrogenated by heating at 650° C. in vacuo for one hour. The powder was passivated by exposing it at room temperature successively to oxygen at a pressure of 13.3, 133.3, 1333 and 13330 Pa. The resulting powder does not react in air at room temperature. The powder was examined with X-ray diffraction; it was then found that it contains $Zr_2Pd$ as intermetallic compound. This compound was present in a matrix of Zr, as appeared from interference microscopy.

The powder was then oxidized in an oxygen atmosphere at a pressure of 133 Pa at 200°–250° C. to such an extent that the ratio 0/Zr, after incorporation in a lamp, was 0.1 (mol/mol). The powder was mixed with nickel powder and was pressed at a presure of 1 MPa around a molybdenum wire of 250 μm to form a cylindrical pill having a diameter of 2 mm.

Figure 2:
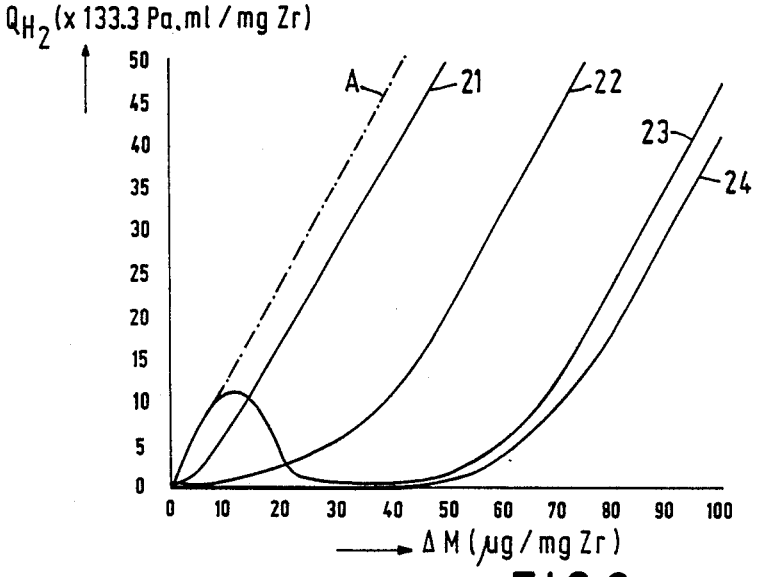
FIGS. 2–7, 9 and 10 are graphs showing the reaction and actions of various getters of the prior art and of the invention with water vapor

In FIG. 2, the mass increase ΔM of a number of materials upon reaction with water vapour is plotted against the accumulation Q of hydrogen gas associated with said reaction.

The dotted line A indicates (also in FIGS. 3 and 4) the accumulation of hydrogen gas in case a material solely binds oxygen from water. If a substance, after having initially bound hydrogen and oxygen, binds solely oxygen at a give instant, the curve of this substance extend from that instant parallel to the dotted line A.

In the group of getters described in the aforementioned German Offenlegungsschrift 1,905,646 getters are included containing at least 5% by weight of Zr and another metal. Since no minimum quantity of the other metal is indicated, pure zirconium would be a material which falls just outside the described group of getters. However, the known getters have a melting point lower than 1250° C. This results in that the known Zr/Ni getters have a Ni content of at least 17 mol.%.

Curve 21 indicates the reaction of Zr with water vapour at 300° C. Initially, with an increasing mass ΔM of the material, a small quantity of the hydrogen formed is absorbed, but soon the curve extends parallel to the dotted line. At the said temperature, zirconium is not a water getter.

Also at 350° C. (curve 22), from the beginning hydrogen is released if Zr binds oxygen from water vapour. Soon hydrogen is no longer bound at all.

$Zr_2Ni$ at 300° C. (curve 23) initially binds solely oxygen from water (curve 23 coincides with the dotted line). Subsequently, the developed hydrogen is absorbed to a fairly low residual pressure. Finally, hydrogen is no longer absorbed, while oxygen continues to be bound.

$Zr_2Pd$ at 250° C. (curve 24) substantially does not develop initially any hydrogen according to this graph and will lose its capability of absorbing hydrogen only at a larger ΔM than $Zr_2Ni$. $Zr_2Pd$ is further more active (at 250° C. (curve 24)) than $Zr_2Ni$ (at 300° C. (curve 23)). $Zr_2Ni$ and $Zr_2Pd$ are intermetallic compounds containing 33.3 mol.% of Ni and Pd, respectively.

Figure 3:
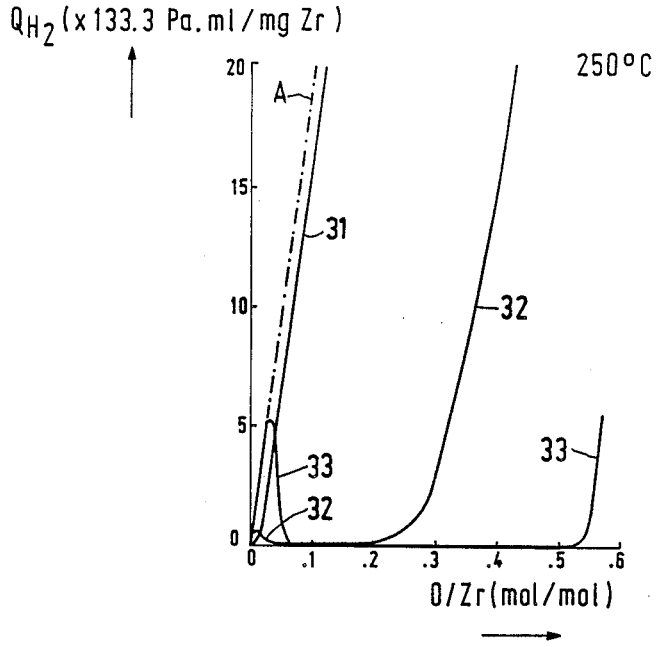

Curve 31 in FIG. 3 shows that Zr at 250° C. binds only initially oxygen and a little hydrogen from water and subsequently binds solely oxygen. Curve 32 corresponds to curve 24 in FIG. 2 ($Zr_2Pd$ at 250° C.). Curve 33 shows that a getter having a metal composition according to the invention containing 8.7 mol.% of Pd, the remainder Zr, can absorb a considerably larger quantity of water vapour stoichiometrically without hydrogen being released than the intermetallic compound $Zr_2Pd$ of curve 32. It appears on the other hand from curve 33 tht the alloy containing 8.7 mol.% of Pd initially releases hydrogen when absorbing oxygen from water vapour. When the 0/Zr ratio (mol/mol) has become about 0.07 however, the hydrogen absorption arrears have been made up. With an 0/Zr. ratio of about 0.03, a larger quantity of hydrogen is already absorbed than that formed by oxygen absorption from water vapour (it being be noted that zirconium/palladium alloys having a palladium content of less than 19 mol.% have a melting point lying above 1250° C.).

Figure 4:
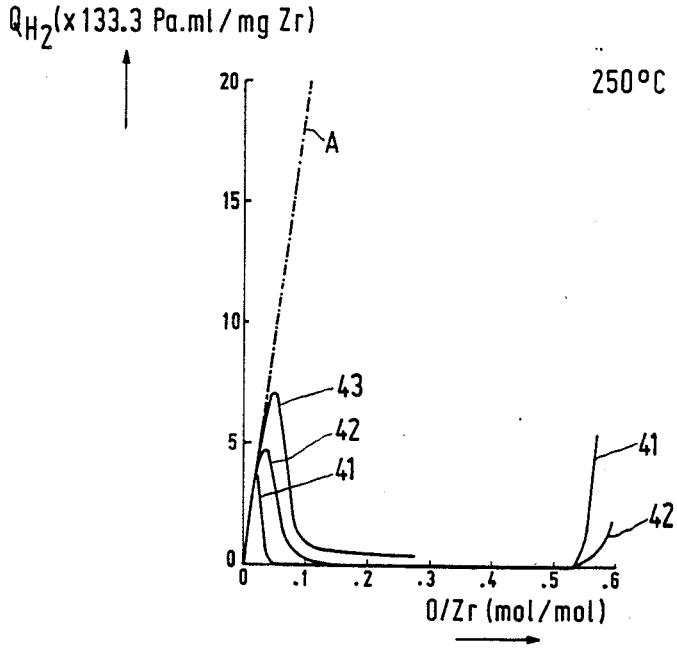

FIG. 4 shows similar curves for alloys containing 8.7 (curve 41), 4.3 (curve 42) and 0.43 mol.% of Pd (curve 43), respectively. With an inreasing Pd content, a larger quantity of hydrogen is released, initially but this quantity is subsequently absorbed. The material, which absorbs hydrogen substantially entirely, has a slightly higher oxygen content in the case of a Pd part content (curve 43) there in the case of a high Pd content (curve 41).

Figure 5:
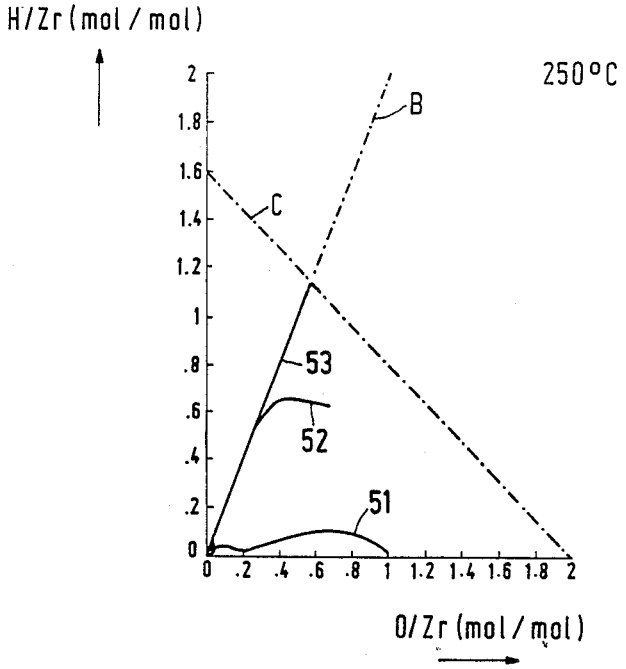

It appears from (curve 51) FIG. 5 that Zr no longer absorbs substantially any hydrogen with an increasing content of oxygen originating from water and finally no longer contains any hydrogen at the point where 0/Zr=1 (mol/mol). The dotted line B indicates the variation of a material absorbing a number of hydrogen moles twice that of oxygen moles, that is to say that this material binds water stoichiometrically. Curve 52 shows that the intermetallic compound $Zr_2Pd$ absorbs water stoichiometrically from water vapour. However, even at a low loading, the compound starts to release hydrogen if an additional amount of oxygen is bound.

Curve 53 shows that with an alloy containing 8.7 and 4.3 mol.% of Pd, respectively, the stoichiometric water vapour absorption continues until the zirconium in the alloy is fully loaded. This is the case where the dotted line B intersects the dotted line C. The getter consequently has the theoretically maximum capacity. The dotted line C indicates the composition of zirconium material fully loaded with hydrogen (intersection point line C with ordinate, $\delta$-$ZrH_{1.6}$) and fully charged with oxygen (intersection point with abscissa, $ZrO_2$) or with hydrogen and oxygen.

When the curve 53 has reached the dotted line C, the material absorbs an additional quantity of oxygen while displacing hydrogen. This Figure shows that materials having the metal composition of the getter according to the invention have a higher getter capacity for water vapour than Zr and $Zr_2Pd$. The favourable difference between zirconium/palladium alloys in the getter according to the invention and $Zr_2Pd$ is also advantageous in view of the comparatively high cost price of Pd.

Figure 6:
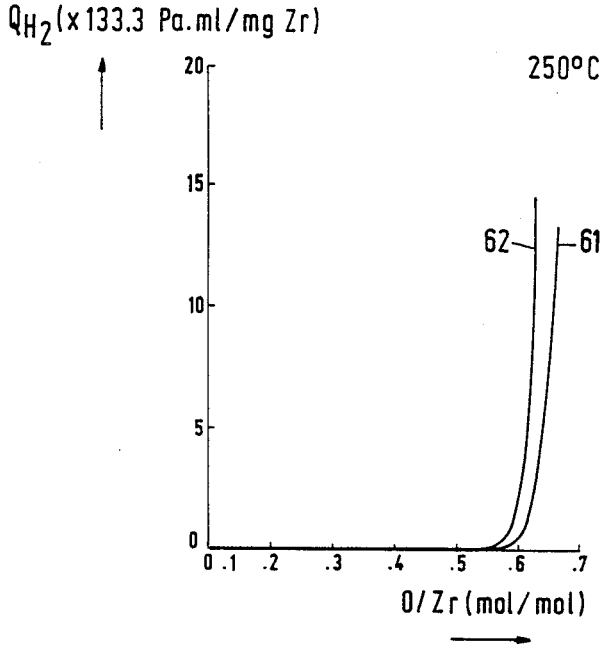

FIG. 6 shows the water vapour absorption behaviour of a getter pill. The pill consists of 8 mg of zirconium/-palladium alloy with Pd=8.7 mol.% and 0/Zr=0.1 (mol/mol) without (curve 61) or with 16 mg of Ni powder addition (curve 62).

Figure 7:
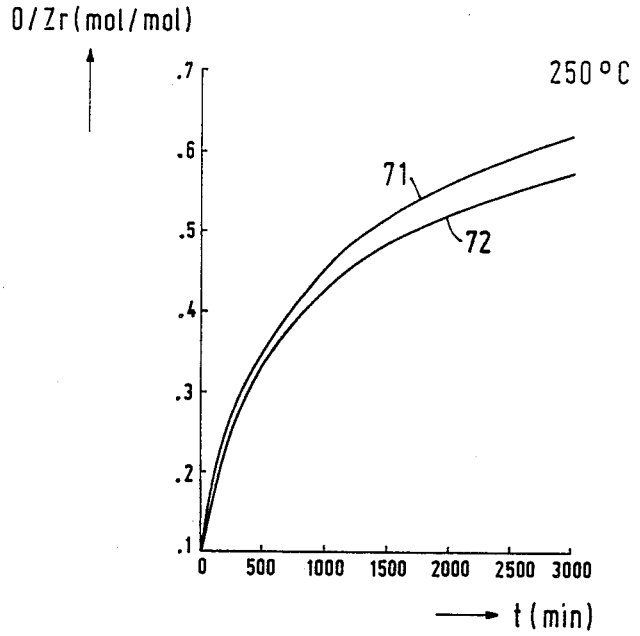

FIG. 7 shows the absorption rate of the two getter pills for water vapour.

It appears from these FIGS. 6, 7 that Ni powder does not contribute to the getter effect. Due to the presence of Ni, however, mechanical stresses in the getter pill are neutralized, as a result of which the latter does not crack and crumble. Consequently, a pill can be readily held in place in the lamp.

In FIG. 8, curve 81 indicates the hydrogen absorption by a sample of passivated zirconium/palladium alloy poor in oxygen (Pd=8.7 mol.%) and curve 82 indicates that of a sample of zirconium/palladium getter according to the invention (Pd=8.7 mol.%; 0/Zr=0.1 mol/mol) with a continuously increasing temperature. The considerably higher absorption rate of the getter according to the invention at temperatures up to 350° C. is clear. The absorption rate of the getter sample according to the invention is lower above 350° C. in the Figure shown because the sample is then already saturated to a great extent with hydrogen.

Figure 9:
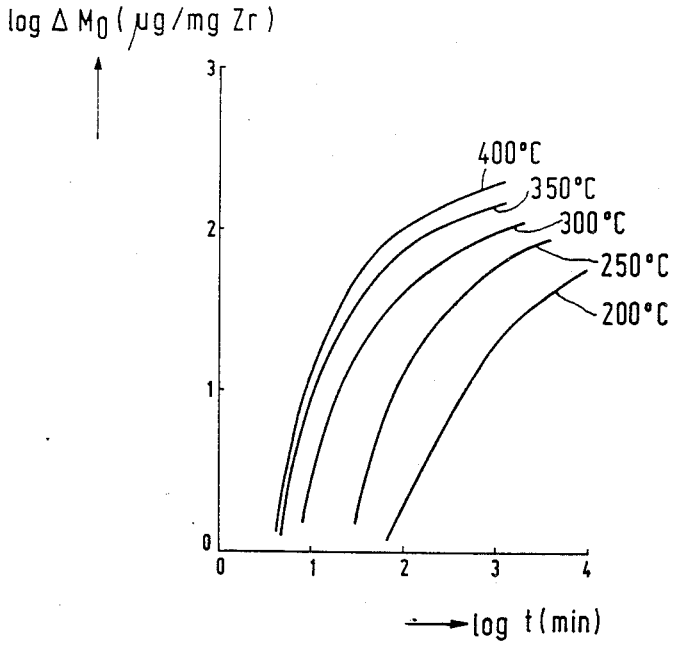

In FIG. 9 the logarithm of the mass increase due to binding with oxygen (AMO) of the vapor reaction with water of the aforementioned pill (where Pd=8.7 mol %, 0/Z=0.1 mol/mol and 16 mg of Ni is present for 8 mg of getter material) in dependence with temperature is plotted against that of temperature. This graph shows the comparatively high reaction speed at comparatively low temperatures of this pill.

Figure 10:
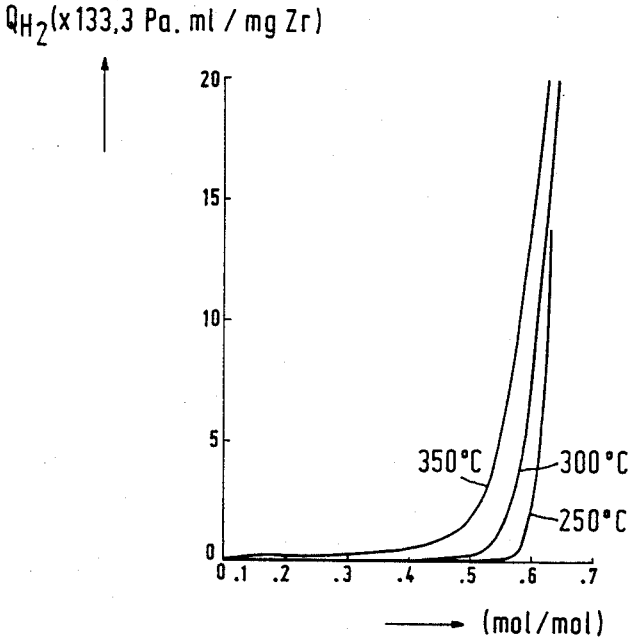

In FIG. 10, with the same pill, the measurements of which are shown in FIG. 9, at various temperatures the hydrogen accumulation upon reaction with water vapour is plotted against the 0/Zr (mol/mol) ratio in the getter. It has been found that at 350° C. a very low residual pressure (less than 0.4 Pa) of hydrogen exists. At 250° and 350° C., the hydrogen residual pressure is less than 0.1 Pa.

What is claimed is:

1. An electric lamp provided with a translucent lamp vessel sealed in a vacuum-tight manner;

a light source arranged within the lamp vessel;

current supply conductors extending from the light source through the wall of the lamp vessel to the exterior;

and a getter within the lamp vessel comprising an intermetallic compound of a first metal with a second metal, characterized in that the getter contains Pd as a first metal, which metal is chemically bound to at least one second metal selected from the group consisting of Zr and Y, the ratio "mole first metal×100%/(mole first metal plus mole second metal)" lying in the range of 0.4–15%, and further contains chemically bound oxygen, the ratio "mole 0/mole second metal" lying in the range of 0.02–1.0 and the getter having a particle size of mainly ≦40 μm.

2. An electric lamp as claimed in claim 1, characterized in that the ratio "mole 0/mole second metal" is first metal plus mole second metal)" is 2–10%.

3. An electric lamp as claimed in claim 2, characterized in that the ratio "mole O/mole second metal" is 0.05–0.2.

4. An electric lamp as claimed in claim 1 characterized in that the ratio "mole 0/mole second metal" is 0.05–0.2.

5. An electric lamp as claimed in claim 1 characterized in that the getter is mixed with nickel powder and is formed into a pill.

* * * * *